United States Patent [19]

Stephens et al.

[11] Patent Number: 4,488,034

[45] Date of Patent: Dec. 11, 1984

[54] DATA REGISTERING APPARATUS

[75] Inventors: Richard J. Stephens, St. Charles, Ill.; Harry H. Boucher, Dallas, Tex.

[73] Assignee: Election Data Corporation, St. Charles, Ill.

[21] Appl. No.: 398,116

[22] Filed: Jul. 14, 1982

[51] Int. Cl.[3] ..... G07C 13/00

[52] U.S. Cl. ..... 235/50 A; 235/50 B; 225/93

[58] Field of Search ..... 235/50 R, 50 A, 50 B, 235/51; 225/93; 29/566.1

[56] References Cited

U.S. PATENT DOCUMENTS

| | | | |
|---|---|---|---|
| 2,923,452 | 2/1960 | Holovks, Jr. | 225/93 |
| 3,178,107 | 4/1965 | Fagan | 235/50 R |
| 3,240,409 | 3/1966 | Harris | 225/93 |
| 3,536,257 | 10/1970 | Laws | 235/50 B |
| 3,772,754 | 11/1973 | Stephens | 29/566.1 |
| 4,297,566 | 10/1981 | Ahmann | 235/50 R |

*Primary Examiner*—Benjamin R. Fuller

*Attorney, Agent, or Firm*—Emrich & Dithmar

[57] ABSTRACT

A data registering apparatus includes a housing, a base member mounted to the housing and a resilient mat member mounted to the base member and having openings superimposed on the openings defined by the base member. The registering apparatus includes also a lower anvil having openings mounted to the base member, an intermediate template member having openings spaced apart from and fixedly mounted to the base member, and an upper mask member having openings and movable from a first, at rest position wherein the upper mask means blocks the openings in the intermediate template member and the anvil to a second position wherein the openings in the upper mask member are in alignment with the openings in the intermediate template member and the anvil, when an unscored data processable card is inserted into the apparatus. A stylus having an angled tip is insertable through the aligned openings in the upper mask, the intermediate template and lower anvil to sever chips or punch portions from the unscored data processable card.

23 Claims, 25 Drawing Figures

FIG. 6
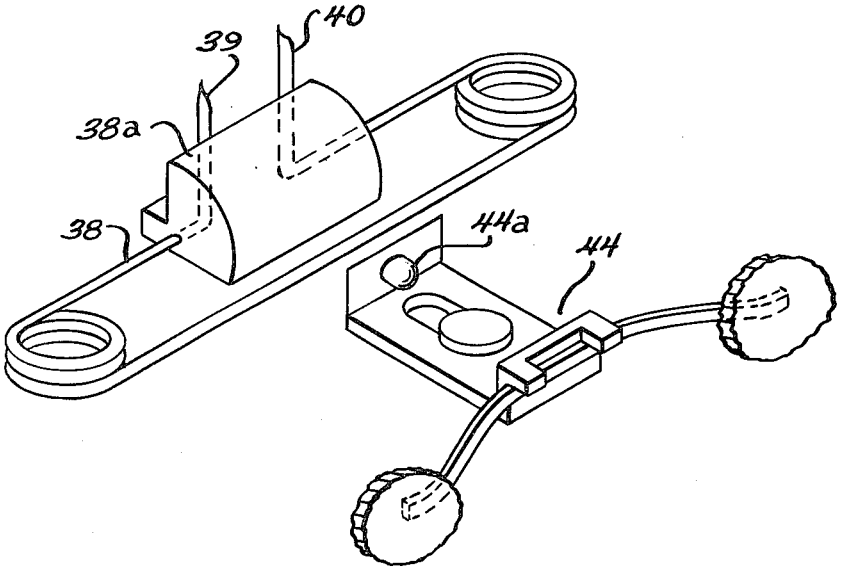
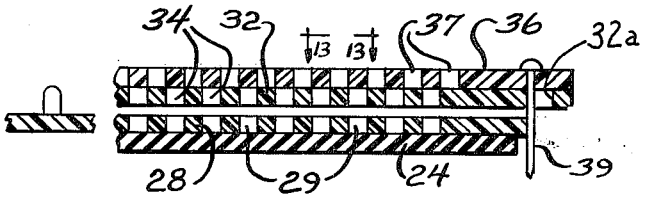
FIG. 7
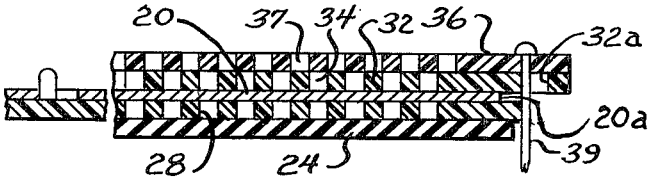
FIG. 8
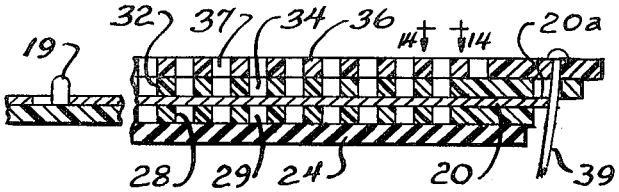
FIG. 9

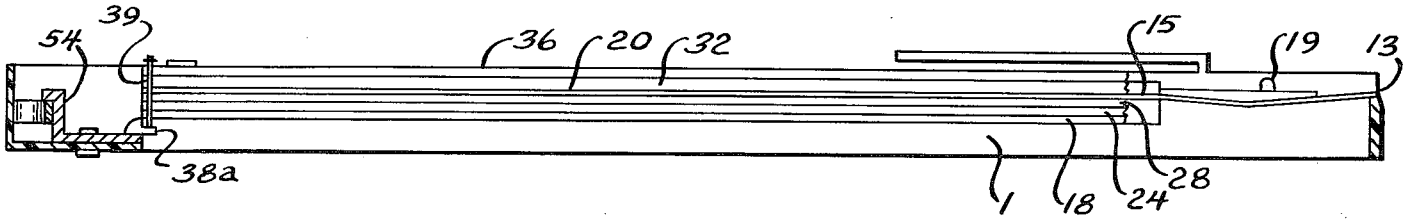
FIG. 10
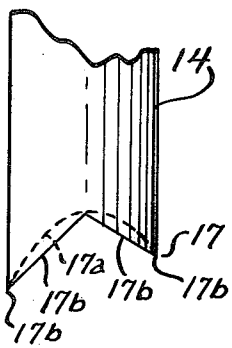
FIG. 11
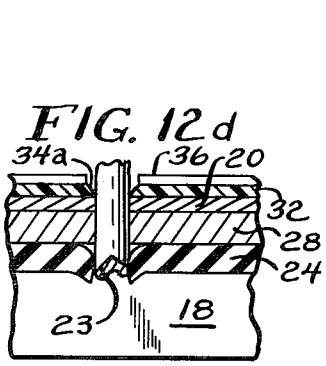
FIG. 12a
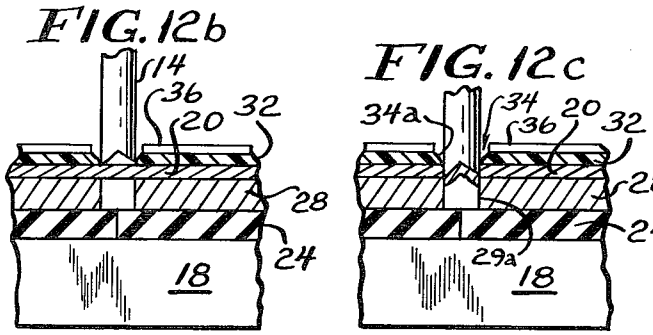
FIG. 12b
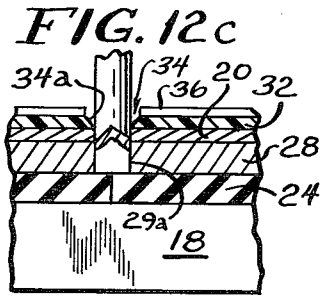
FIG. 12c
FIG. 12d
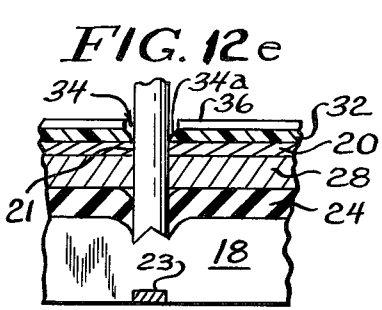
FIG. 12e
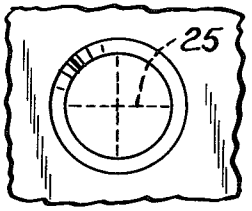
FIG. 14
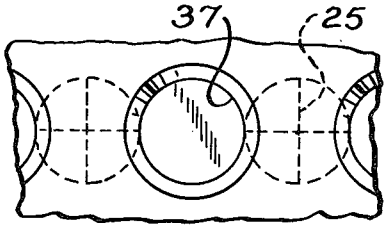
FIG. 13

FIG. 15
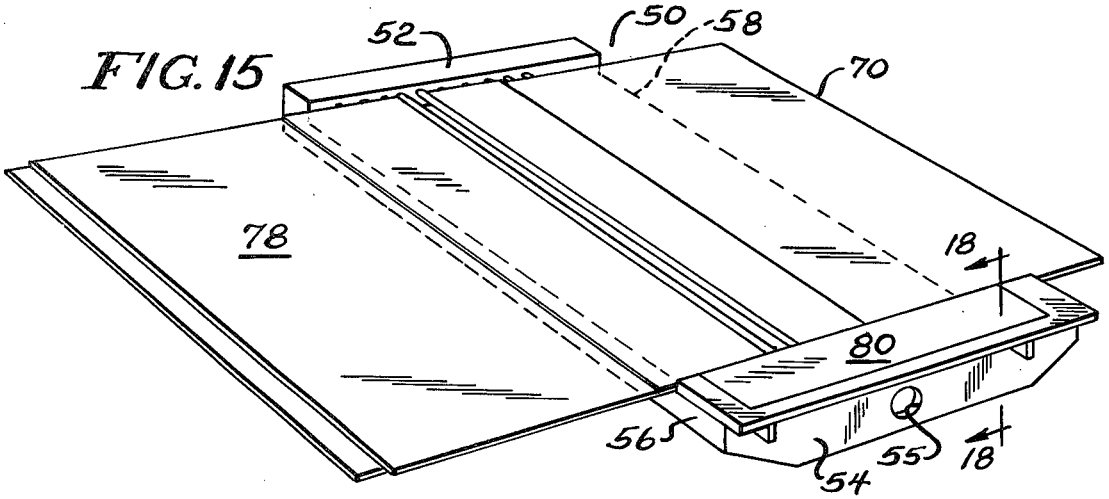
FIG. 16
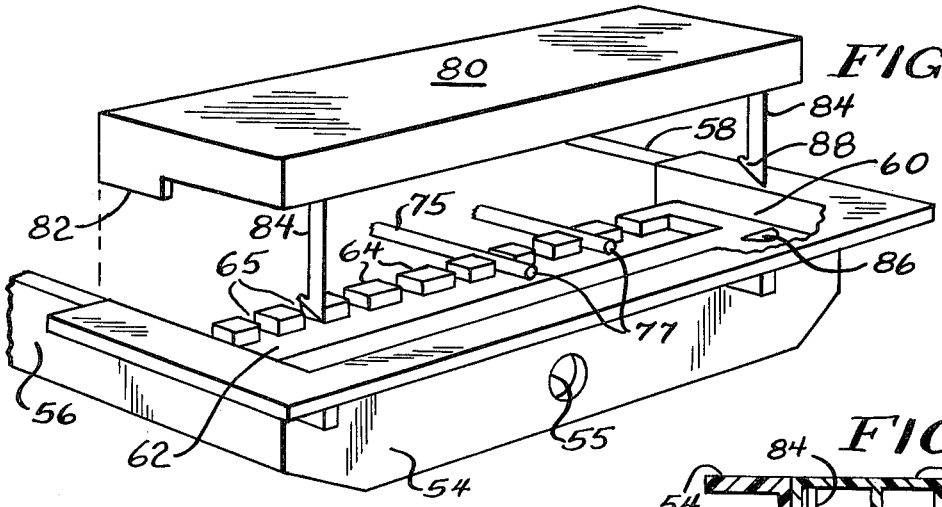
FIG. 18
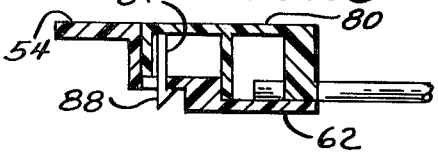
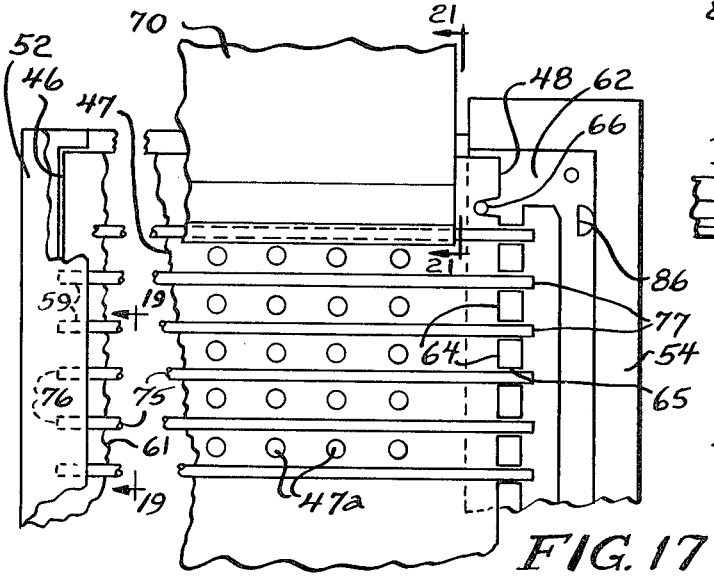
FIG. 17
FIG. 19
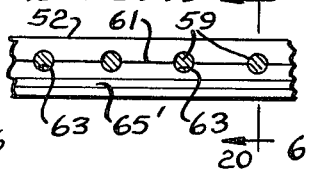
FIG. 20
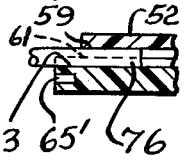
FIG. 21
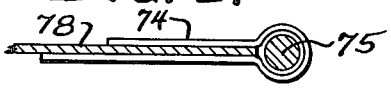

DATA REGISTERING APPARATUS

BACKGROUND OF THE INVENTION

The present invention relates to an apparatus or voting mechanism for the manual registration of data on a machine processable unscored data or record card.

Data registering devices for the cataloging or recording of information on a data processing or record card, requiring the utilization of information panels in close proximity with the data processing record card, have been described in the prior art. For example, U.S. Pat. No. 3,240,409 describes a data registering device having removable information panels containing a statement of the data sought mounted on a rectangular frame and including an outer template attached thereto and an inner template member slidably disposed upon a grooved housing member. Positioned between the inner template member and the grooved housing member is a prescored data or record card which cooperates with the inner and outer templates to permit the recordation of information on the data card. The prescored data or record card rests upon the grooved housing member, which includes a plurality of rubber backing strips mounted thereon which cooperate with a stylus to assist in the punching and removal of the scored portions of the data processing card during registration of data. Additionally, U.S. Pat. No. 3,536,257 describes a data registering device or vote recorder having removable information panels positioned above an inner template member and a prescored data processing card positioned between the inner template member and a base frame member. The base frame member includes a rubber backing mounted thereon which cooperates with a stylus to assist in the removal of the punch-scored or chip portions which have been predeterminedly and selectively punched and removed from the scored data processing card. Additionally, U.S. Pat. No. 2,923,452 describes a perforating mechanism for prescored data or record cards wherein the card is positioned between upper and lower template members, which members cooperate with a punch to punch out the prescored areas in the prescored data or record processable card.

However, such prior art devices and mechanism require the usage of prescored data processing cards which do not always cleanly and uniformly remove the prescored portion therefrom during usage of the card. Accordingly, it has been found necessary to manually inspect each of the data or record processable cards prior to their insertion into a computer or other tabulating machine to insure that all punched portions had been cleanly removed therefrom before the card may be processed in the computer apparatus. This lengthy and time complicated problem of removing the unscored several chips, or punched portions, from the data card and the attendant high labor costs required to do this have prevented the widespread acceptance of data registering devices for use as voting machines.

Additionally, because election codes require that the official ballots be retained until contested elections are resolved, the prior art data registering devices are not tamper-proof, but instead permit the ballot pages to be removed from the information panel holders. Accordingly, such devices have found only limited application. Additionally, the required use of prescored data record cards and the increased cost thereof incident to prescoring of each such data card, have resulted in limited acceptance and use of such data registering devices as voting machines because of the substantial costs attendant thereto.

SUMMARY OF THE INVENTION

It is an object of the present invention to provide a novel data registering apparatus or voting mechanism which utilizes an unscored data processable record card.

It is a further object of the present invention to provide a novel stylus for use with the data registering apparatus or voting mechanism in accordance with the present invention which shears predetermined and selected openings in unscored record cards to register to record the user's vote.

It is still another object of the present invention to provide an inexpensive and novel tamper-proof holder or frame member which is adapted to receive indicia or a ballot and to position and hold the same in registry with the data registering apparatus.

In the present invention, the data registering apparatus or mechanism includes a housing and a base or backing frame mounted to the housing. The backing frame includes a plurality of spaced apart elongated reinforcement members extending the length thereof onto which a rubber or resilient mat is affixed. The scored portions of the rubber mat include a plurality of criss-crossed slits therein which cooperate with the openings defined by the plurality of elongated reinforcement members, as will hereinafter be described. Mounted onto the backing frame of the housing is a lower anvil or template, preferably metal, having a plurality of aligned openings therein. Positioned on top of the lower anvil or template member and spaced apart therefrom is, preferably, comprised of a plastic material, an intermediate template member having a plurality of openings which are aligned with the openings in the lower anvil member. The spacing between the plastic intermediate template and lower anvil member is such to permit the insertion of an unscored data processing or record card, upon which is entered predetermined and selected openings or perforations therein which record the tabulation, statistical or other information as desired, as will hereinafter be described.

Positioned on the intermediate template member is an upper mask or template member which is slidably movable from an inoperable or first position, wherein the mask prevents a stylus from extending through the openings in the upper mask member, the intermediate template member, the unscored record card and lower anvil member, to a second operative position wherein the openings in the upper mask, intermediate template member and lower anvil member are in aligned and superimposed relationship. The upper mask or template member is engageable with a finger spring member or means mounted to the housing which biases the upper mask member to hold the member in a first position wherein the openings in the mask member are not aligned with the openings in the plastic and metal anvil. Upon insertion of the unscored data processing or record card between the lower anvil and intermediate template member, the end of the data processing card engages the finger spring member to move the spring member and the upper mask member and the openings therein to position the same in alignment with the openings in the intermediate template and lower anvil members.

The data registering apparatus or mechanism further includes a rectangular shaped holder or frame member comprised of a pair of longitudinally extending side members and a pair of end members. One of the end members includes indexing openings and recesses cooperating thereto and the opposite end member includes indexing grooves therein. The rectangular holder or frame member is adapted to receive cards or sheets mounted on rod-like projections which extend the length thereof, and the one end, having the grooves therein, cooperates with a locking and tamper-proof plate which is positioned onto the end of the holder and sealed thereto. The rectangular holder or frame includes also an outer mask or template member positioned in the rectangular holder of frame which includes a plurality of predetermined openings therein which register with the predetermined indicia on the card receiving members positioned in the rectangular holder or frame, which predetermined openings align and register with the aligned openings in the lower anvil and intermediate template members, when the rectangular frame member is positioned on the data registering apparatus. When the card receiving members have been positioned within the aligned openings and grooves of the rectangular frame, a tamper-proof plate, having weakened projection tips thereon, is securely fastened to the rectangular frame member to firmly retain the card receiving members or ballot instructions and the outer mask template member in a secured and unitary manner.

The data registering apparatus housing includes also a spring biased projection member which engages an extension of the rectangular frame member to firmly retain the same in registry with the elements of the data registering mechanism. Present election codes and laws require that the official ballots be retained until contested elections are resolved. Accordingly, the present disclosed rectangular frame member is tamper-proof in that if the locking plate is removed, the projecting tabs thereon will be severed, thereby indicating if any ballots or outer template have been removed or tampered with.

The present data registering apparatus utilizes a stylus which is sized and adapted to slidably move within the apertures and openings in the outer template, the upper mask or template member, the intermediate template member and lower anvil member. The stylus is, preferably, tubular in shape and includes an angled recessed end thereon. When the unscored data processing card is inserted between the lower anvil and intermediate template, and engages the finger spring member to move the upper mask or template member into the operative and aligned position, the angled-tipped stylus is then inserted downwardly through the aligned openings. Upon engagement with the unscored data processing card, the angled recessed end shears a clean circular opening through the unscored data processing card. Upon further downward movement of the angled stylus tip, the severed chip, or punched portion from the unscored data processing card is firmly retained by the criss-crossed slits in rubber mat positioned on the base or backing member to firmly remove the chip from the data registering apparatus. This shearing action between the angled-tipped end of the stylus and the lower anvil positioned below the unscored data processing card insures a precisioned shearing operation on the data processing card which eliminates the need for manually inspecting each record card after completion of the voting or registering operation. Additionally, the increased efficiency of using inexpensive solid unscored data processing cards eliminates the costs involved in prescoring data processing cards for use in such registering mechanism, a result which is a significant and novel improvement over the prior art references and mechanisms.

Importantly, the tamper-proof feature of the rectangular frame holder of the card receiver members and outer template insures an efficient and tamper-proof data processing apparatus or voting mechanism in accordance with the present invention. The rectangular frame member is reusable except for the tamper-proof plate member, which may be removed after usage, and the data registering apparatus is reusable time and time again except for the need for obtaining additional unscored data processing cards.

DESCRIPTION OF THE DRAWINGS

FIG. 6 is a perspective view of the finger spring member engageable with the upper mask or template member and the leaf spring member engageable with the rectangular shaped holder to retain the same in engagement with the data registering apparatus in accordance with the present invention;

FIGS. 7, 8 and 9 are enlarged fragmentary cross-sectional views showing the insertion of the unscored data processing card between the lower anvil and intermediate template members and the engagement of the data processing card with the finger spring member to move the upper mask or template member from the inoperative position to the operating position in accordance with the present invention;

FIG. 10 is a longitudinal sectional view taken along lines 10—10 of FIG. 5 in accordance with the present invention;

FIG. 11 is an enlarged cross-sectional view of the stylus tip used with the data registering apparatus in accordance with the present invention;

FIGS. 12*a*–12*e* are enlarged fragmentary cross-sectional views showing sequentially the cooperation between the stylus tip and the lower and intermediate anvil or template members and the engagement with the unscored data processing card as a selection is made by a user in punching out a preselected and predetermined opening on the data processing card with the stylus during operation of the voting machine in accordance with the present invention;

FIG. 13 is a top plan view taken along lines 13—13 of FIG. 7 illustrating the inoperative or at rest position of the upper mask or template member with respect to the lower and intermediate anvil or template members in accordance with the present invention;

FIG. 14 is top plan view taken along lines 14—14 of FIG. 9 illustrating the registry of the openings in the upper mask or template with respect to the openings in the lower and intermediate anvil or template members when the upper mask or template member is moved to the registry position in accordance with the present invention;

FIG. 15 shows a perspective view of the rectangular shaped holder in accordance with the present invention;

FIG. 16 is an enlarged fragmentary view of the rectangular shaped holder useful with the data registering apparatus in accordance with the present invention;

FIG. 17 is an exploded top plan view partially broken away of the rectangular shaped holder and card receiving members useful with the data registering apparatus in accordance with the present invention;

FIG. 18 is a cross-sectional view taken along lines 18—18 of FIG. 15 illustrating the positioning of card receiving members and the tamper-proof plate to the rectangular shaped holder to secure the card receiving members in the holder in accordance with the present invention;

FIG. 19 is a fragmentary enlarged end view taken along lines 19—19 of FIG. 17 of the one end of rectangular shaped holder in accordance with the present invention;

FIG. 20 is a cross-sectional view taken along lines 20—20 of FIG. 19 showing the index openings and groove portions of the end of the rectangular shaped holder in accordance with the present invention; and FIG. 21 shows a cross-sectional view taken along lines 21—21 of FIG. 17 illustrating the positioning of the instructional and tabular material in accordance with the present invention.

DETAILED DESCRIPTION

Figure 1:
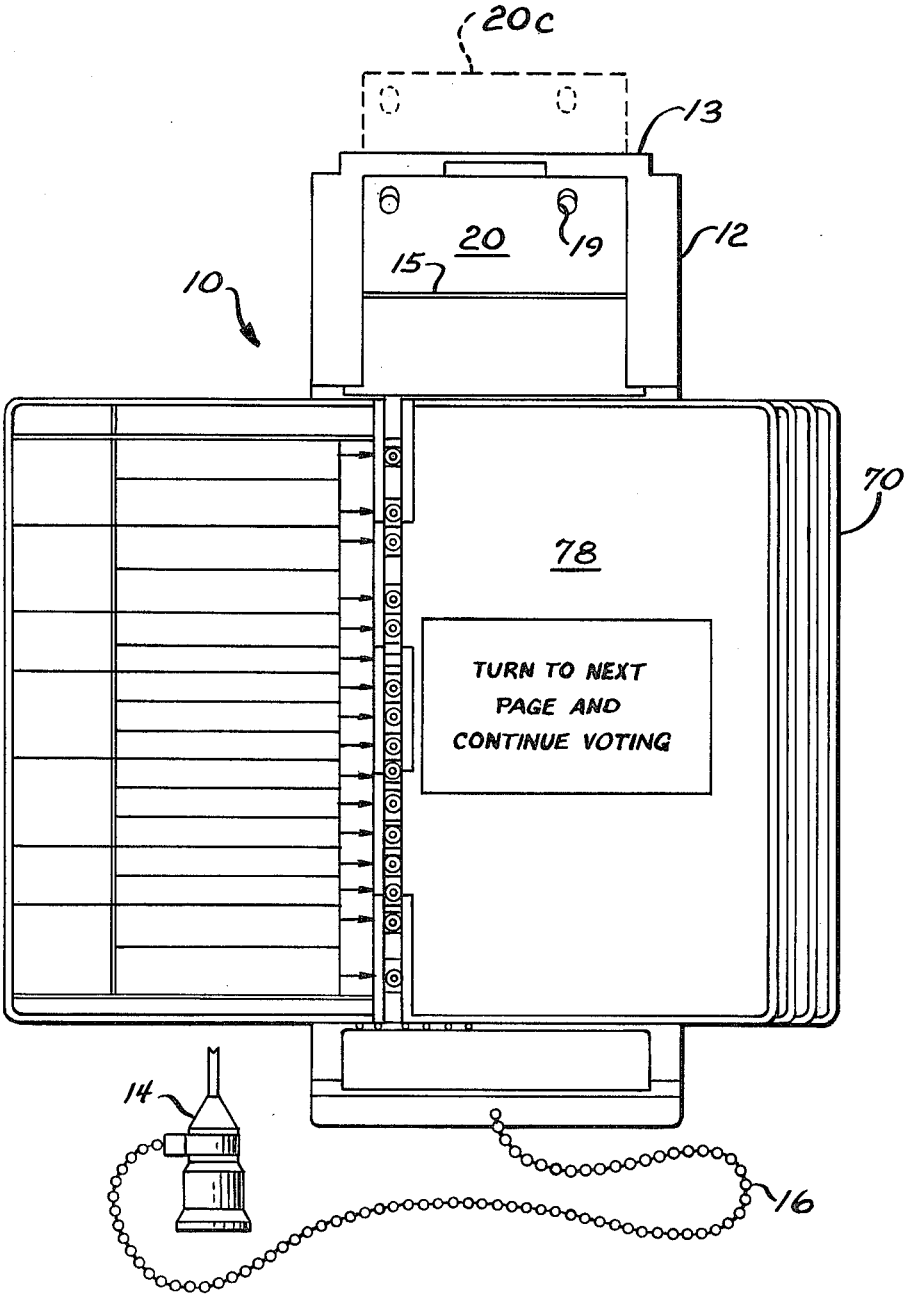
FIG. 1 is a top elevational view of the data registering apparatus or voting mechanism in accordance with the present invention.

Referring now to the drawings wherein like numerals have been used throughout the several views to describe the same or similar parts, in FIG. 1, there is shown a data registering apparatus or voting mechanism 10 which has particular applicability as a vote recorder and which is constructed in accordance with the features of the present invention.

The data registering apparatus or mechanism 10 includes a housing 12 and a data processing card punching stylus 14 connected with the data registering apparatus by a flexible linkage or chain 16, which permits the voters to utilize the stylus when making selections during the voting process. Although it is not shown in FIG. 1, if it is desired, the housing 12 may be mounted within a base member 11 (shown in FIG. 2) which is of a larger size and which firmly retains the voting apparatus or mechanism 10 within a voting booth. The housing 12 includes and end 13 having a slot or longitudinal opening 15 (FIG. 10) through which the unscored data processing or record card 20 is positioned within the apparatus 10.

Figure 4:
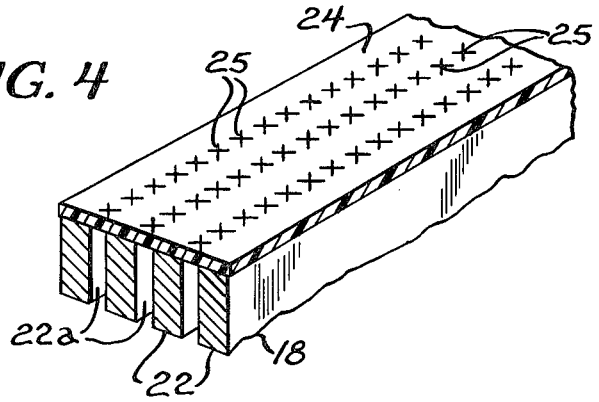
FIG. 4 is an enlarged perspective view showing the base or backing member and resilient mat mounted thereon in accordance with the present invention.
Figure 5:
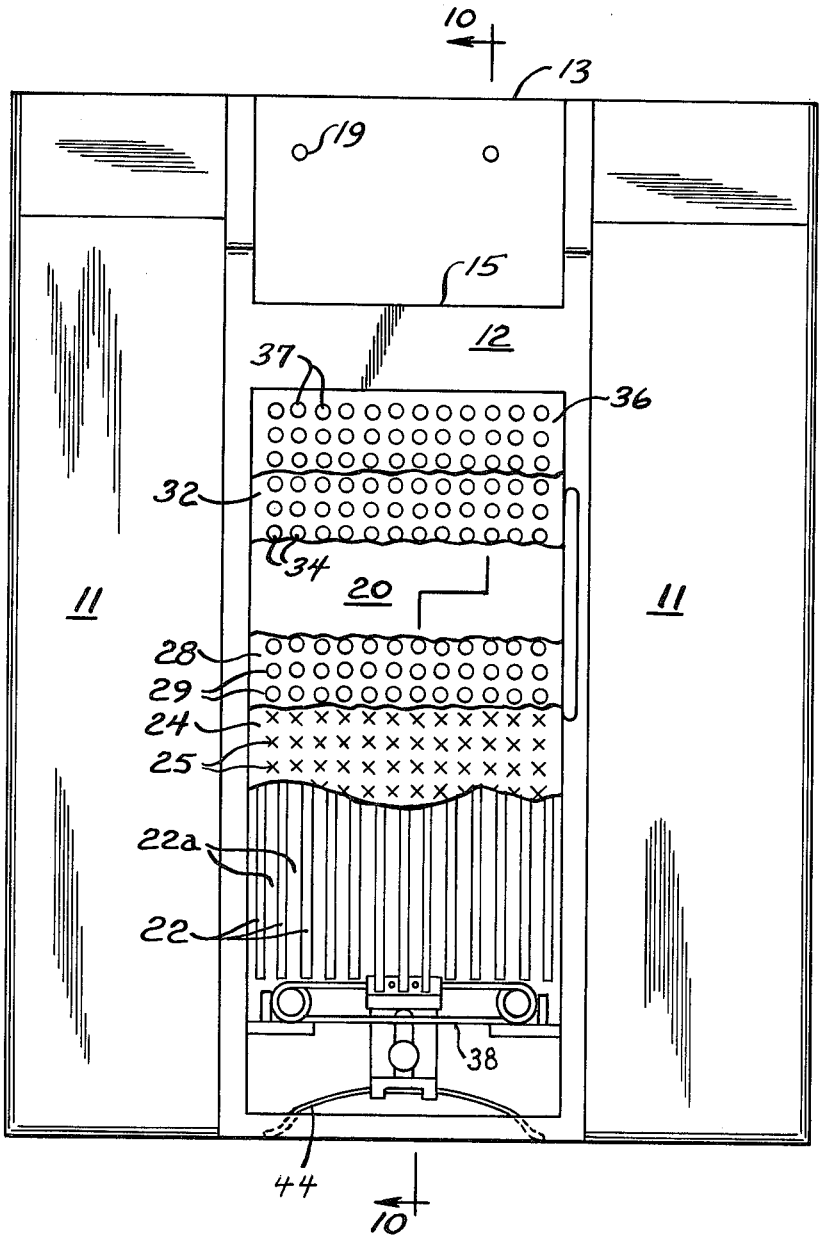
FIG. 5 is a top elevational view of the data registering apparatus in accordance with the present invention with the rectangular shaped holder and indexing receiving members thereon removed for clarity.

As shown in FIGS. 4 and 5, the housing 12 includes a base or backing member 18 which extends substantially the length of the housing 12 and which is comprised of a plurality of aligned and spaced apart elongated reinforcement members 22 having, preferably, a one-piece rubber or resilient mat 24 mounted to the upper surfaces thereof. As shown in FIG. 4, the portion of the resilient or rubber mat 24 extending over the openings 22*a*, defined by the elongated reinforcement members 22 of the base member 18, includes a plurality of criss-cross cut slits 25 therein which cooperate with the stylus 14, as will hereinafter be described. The size of the base or backing member 18 and resilient mat thereon is not critical to the present invention except that it should be at least as large as the unscored data processing or record card 20 which is inserted through slot 15 into the data registering apparatus 10. Importantly, the size and shaping of the elements of the data registering apparatus in accordance with the present invention are designed to accommodate data processing cards without reference to the card's size and shape, as it is will understood in the art.

Figure 3:
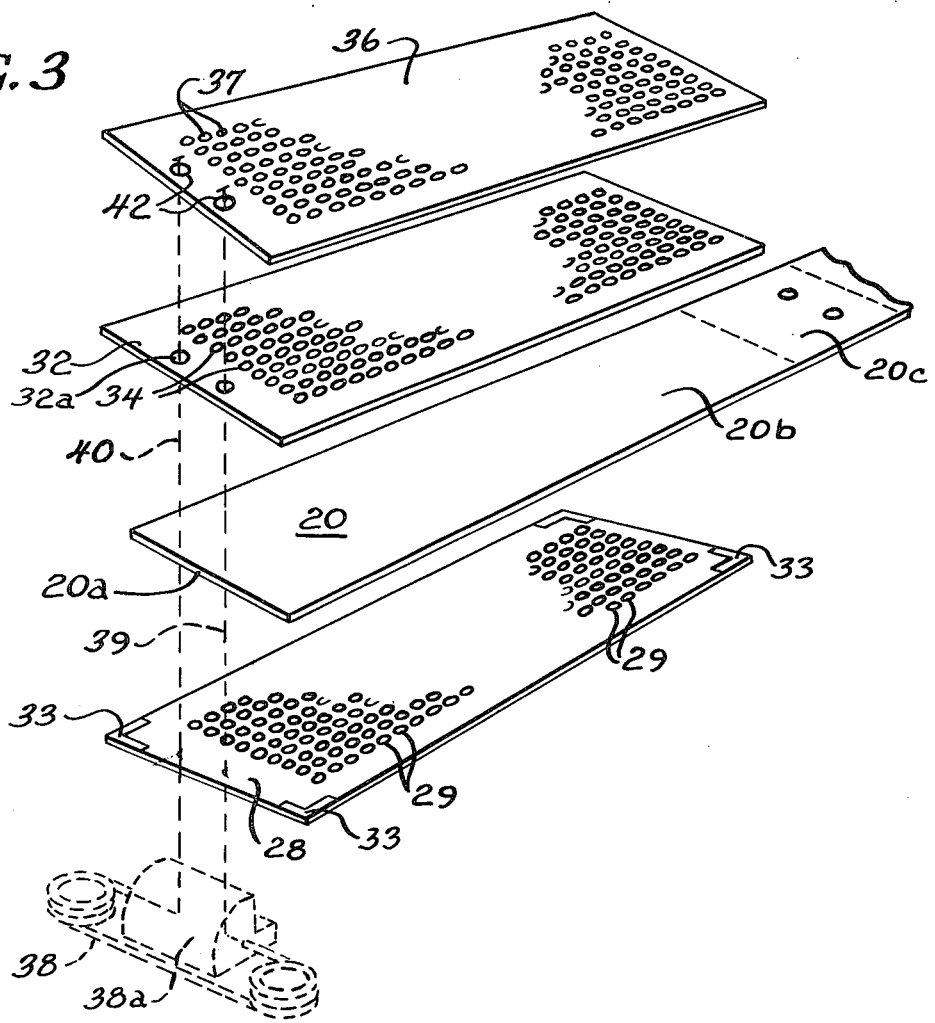
FIG. 3 is a fragmentary exploded perspective view of the elements of the data registering apparatus in accordance with the present invention.

As shown in FIGS. 3 and 5, fixedly positioned adjacent to and mounted on the base or backing member 18 is a lower anvil or template member 28 having a plurality of openings 29 therein which cooperate with the angled stylus end tip 17 (FIG. 11) to provide the punch out or openings 21 in the unscored data processing or record card 20 in a preselected and predetermined pattern by a user of the data registering mechanism or voting device 10, as will be discussed more fully with respect to FIGS. 12*a*–12*e*. Also, it is within the scope of the present invention that the lower anvil or template may be comprised of a metal or hard plastic material, the only requirement being that the edge 29*a* of the openings 29 provide a shearing action with the angled stylus end tip 17, when punching the opening 21 in the card 20.

An intermediate template member 32 is fixedly mounted on top of the lower anvil or template 28. Importantly, a spacer member or means 33 is mounted between the lower anvil member and the intermediate template member to separate the two members a sufficient distance to permit the ready insertion of the unscored data processing card 20 therebetween during usage of the data registering apparatus 10. The intermediate template member and lower anvil member are fixedly mounted to the base member 18 or housing 12 in such a manner by fastener means (not shown) that they are fixedly mounted and immovable when in proper assembled relationship. The intermediate template member 32 includes a plurality of openings 34 therein which, preferably, include a beveled portion 34*a* thereon (best shown in FIGS. 12*a*–12*c*) and which are in aligned relationship with the openings 29 in the lower anvil member 28 and which assists in the guidance of the stylus 14 during the shearing action of the unscored data processing card, as will hereinafter be described. Also, the intermediate template member 32 includes openings 32*a* therein which are adapted to receive the finger ends of the spring member, as will hereinafter be described.

As shown in FIGS. 5 and 6, the housing 12 includes a finger spring member or means 38 mounted thereon which extends upwardly from the housing and which is engageable with a slidably mounted upper mask or template member 36 which is slidably positioned and mounted onto the intermediate template member 32. The finger spring member 38 is best shown in FIG. 6 and includes finger ends 39 and 40 which extend upwardly through openings 32*a* in the template member 32 and through openings 42 in upper mask 36 (FIG. 3) to engage and hold the upper mask or template member 36. Although there are many spring means structures useful in the present invention, the preferred spring means includes a plastic housing 38*a* molded about finger ends 39 and 40, which cooperates with housing 12 to bias the finger ends 39 and 40 to a substantially perpendicular position with respect to the housing 12.

The finger spring means 38 is so positioned in the housing 12 that the upper mask or template member 36 is biased to a first, at rest position wherein the openings 37 in the upper mask or template member 36 are in a position with respect to the openings 29 and 34 in the lower and intermediate anvil members 28 and 32 respectively to block and prevent the stylus tip 17 from penetrating the openings 34 in the intermediate template member 32, the position as shown in FIGS. 7 and 13. Upon the insertion of a data card 20 into the voting mechanism 10, the card end 20*a* engages the finger ends 39 and 40 (FIG. 9) to move the upper mask member 36 to the second actuated position wherein the openings 37 therein are in alignment with openings 29 and 34 in the lower anvil and intermediate template members, respectively, the position shown in FIGS. 9 and 14. As is apparent from FIGS. 3 and 7–9, the openings 32*a* in member 32 confines the inward movement of the finger ends 39 and 40 to the aligned-actuated position, as shown in FIG. 9.

The data processing card 20 for use with a data registering apparatus 10 for recording information by entering perforations on selected portions thereof, includes a first portion 20*b* the end 20*a* of which is engageable with the upper template member 36 to move the same to the actuated, second position by engaging finger spring 38. Importantly, the first portion 20*b* is unscored such that upon engagement by the stylus 17, the stylus, cooperating with the anvil member 28 makes perforations in the card. The second portion 20*c* of the card is removably detachable from the first portion and the second portion is engageable with the apparatus for inserting and holding the first portion in the apparatus during usage of the apparatus.

Figure 2:
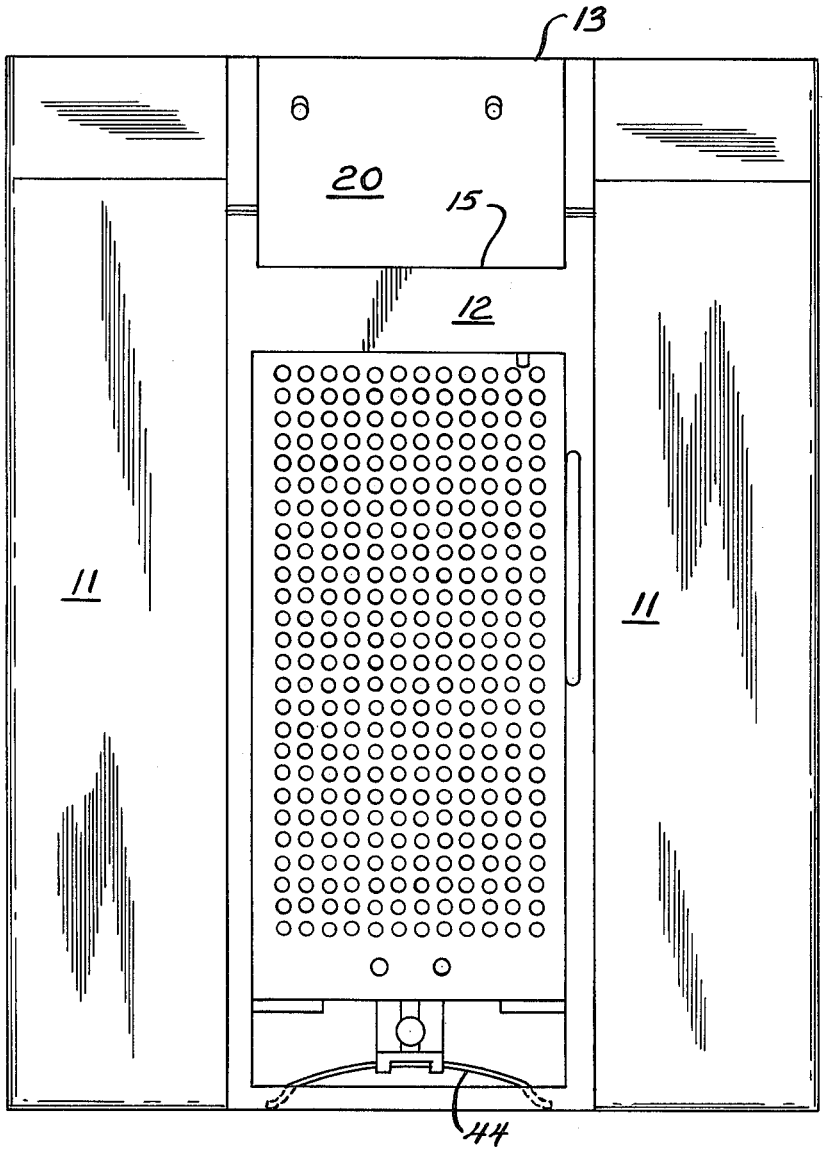
FIG. 2 is a top plan view of the data registering apparatus wherein the rectangular shaped holder and indexing receiving members have been removed for clarity.

Referring now to FIGS. 1 and 15, there is shown a rectangular holder or frame member 50 for positioning information material in close proximity with the data registering apparatus 10. The information material may include a card, a panel, a sheet or page of the general class of material having indicia or instructions thereon for communicating a statement for the type of data sought or required by that data registering apparatus or voting machine 10. The rectangular holder or frame 50 is composed of a plastic material and is formed by ends 52 and 54 and by sides 56 and 58. End 54 may include an opening 55 therein which opening permits the holder 11 to be secured to the data registering apparatus by spring means 44 mounted to the housing 12, as shown in FIGS. 2, 5 and 6, and which is well known in the art.

End 52 of the rectangular holder or frame 50 includes a plurality of indexing openings 59 (FIG. 19) which extend across the length thereof and which assist in positioning and holding the card receiving member 70, as will hereinafter be described. Extending across the length of end 54 is a shelf plate 62 (FIG. 17) molded integrally thereto, which plate includes a plurality of projections 64 extending upwardly therefrom which define indexing openings 65 therebetween (FIG. 16), which openings are in parallel alignment with the indexing openings 59 in end 52 and which cooperate together in maintaining and holding the card receiving member 70 in operating position with respect to the data registering apparatus 10.

In FIGS. 19 and 20, the end 52 is shown having a plurality of indexing openings 59 extending across the length thereof. End 53 includes also a shelf projection 61 (FIG. 17) which extends inwardly towards end 54 and which includes a plurality of indexing grooves 63 (FIG. 20) which extend into each of the indexing openings 59. The indexing grooves permit the ready insertion of the one end of the rod portion or member 75 of the card receiving members 70 into the indexing grooves and facilitate insertion of the end thereof into the indexing openings 59. Additionally, the shelf projection 61 includes a recessed channel 65' (FIGS. 19 and 20) extending across end 52 which openings is adapted to receive one end 46 of an outer template member 47, having opening 47*a* therein, while the other end 48 rests upon shelf plate 62 on end 54. If desired, a projection or knob 66 may be positioned upon the shelf plate 62 to permit proper indexing of the outer template member 47 to the rectangular holder or frame 50, as is shown in FIG. 17.

The card receiving member 70 is preferably comprised of elongated body or card receiving portion 74 (FIG. 21) which is positioned about a rod member 75 and which generally includes some type of adhesive means on the inside thereof for engagement of the panel or sheet or page 78 of the general class of material having indicia or instructions thereon for communicating a statement for the type of data sought or required by the data registering apparatus or voting machine. However, it is within the scope of the present invention that the card receiving member 70 may be of the type described in U.S. Pat. No. 3,772,754, issued to one of the inventors of the present invention, or it may be of the type described in U.S. application Ser. No. 500,624, now abandoned, which abandoned application relates also to one type of rectangular holder member.

When the rod ends 76 and 77 of rod 75 (FIG. 17) have been inserted into the indexing openings 59 and 65, respectively, tamper-proof plate member 80 (see FIGS. 16 and 18) is firmly secured onto the opening 60 in end 54 of the rectangular holder or frame 50 to secure the card receiving member or members 70 in the frame 50. The tamper-proof plate member 80 includes a lip portion 82 which extends over and firmly about the projections 64 on shelf plate 62 and includes also at least one tamper-proof extension 84 which matingly ingages with half moon like openings 86 in shelf plate 62 when the tamper-proof member 80 is firmly seated within opening 60 of end 54. The tamper-proof extensions 84 are weakened intermediate the length thereof such that once the tamper-proof member 80 has been attached to end 54 of the holder or frame 50, when the user attempts to remove member 80, the extension end 88 will be broken off to indicate such tampering or removal. Accordingly, such a structure insures against any violation of election laws by preventing users of the voting mechanism 10 from somehow changing the ballot or otherwise tampering with the election process.

The operation of the data registering apparatus or voting mechanimsm 10 may be described with reference to FIGS. 1 and 2, 7–9 and 11–14. For example, if the data registering apparatus 10 is to be utilized as a vote recording mechanism, the rectangular holder or frame 50 is loaded with a plurality of card receiving members 70 which are comprised of a card receiving portion 74 engageable with a rod member 75. When the outer template member 47 has been positioned in frame 50 and a plurality of the card receiving members have been properly positioned in the rectangular holder or frame 50, the frame 50 is inserted over the loading mechanism or apparatus shown in FIG. 2 such that the spring means 44 and projection 44*a* (FIG. 6) engage the opening 55 and end 54 of the frame 50, the position as shown in FIG. 1. Thereafter, an unscored data processing or record card 20 is inserted into slot 15 in end 13 of the housing 12 such that the unscored card extends into the mechanism between the lower anvil or template member 28 and the intermediate template member 32, a position as shown in FIG. 8. Upon the full insertion of the unscored record card 20 into the mechanism, the end 20*a* thereof engages the finger extensions 39 and 40 of the finger leaf spring member or means 38 and moves the same, as well as the upper mask or template member 36, from the at rest position to the actuating or second position such that the openings 37 therein are in aligned relationship with the openings 34 and 29 in the intermediate template member and the lower anvil or template member 28, respectively, the position as shown in FIG. 9. When the data card 20 is in the fully inserted position, the data card is positioned about a projecion 19 (FIGS. 1 and 10) to lock the card in the fully inserted position. The predetermined openings 47*a* in the template member 47, as is known in the art, cooperate with the card receiving members 70 and the indicia thereon to indicate to the user of the data registering apparatus 10 the aligned openings 37, 34, and 29 of the upper template member 36, to intermediate template member 32 and the lower anvil 28, respectively, which are to be selected in severing a chip from the processing card 20.

When the user desires to select or predeterminedly punch an opening in the unscored card, the user grasps stylus 14 and proceeds downwardly through the openings 37 in the upper mask or template member 36, the position as shown in FIG. 12*a*. The stylus 14 (FIGS. 1 and 11) is generally circular in cross-section and includes an angled tip end 17 having, preferably, a recessed opening 17*a* therein which provide a sharp cutting edge 17*b* therearound which cooperates with the openings 29 in the lower anvil member 28 to provide a shearing action in removing the severed chips, or punched portions from the card 20, as will hereinafter be described. When the stylus tip end 17 has extended downwardly through opening 34 in the intermediate template member 32, the stylus tip engages the unscored data processing card 20, the position as shown in FIG. 12*b*. The angled stylus tip end 17 may include an angled recess of about 90 degrees and have a circular cross-sectional shape with the end portion thereof being concave, as shown by the dotted line in FIG. 11. Also, it is within the scope of the present invention that the angled recess of the stylus tip end 17 may be more or less than about 90 degrees. Upon the further downward movement of the stylus tip 17, the angled tip edges 17*b* engages the edge 29*a* of the openings 29 and the lower anvil or template member 28 to shear and cleanly cut an opening in the unscored data card 20, the position as shown in 12*c*. Upon the further downwardly movement of the stylus tip end 17, the angled tip carries the severed chip or punched portion 23 through the criss-cross slits 25 of the one-piece resilient mat 24. The criss-crossed slits act as finger extensions to grab the severed chips 23, the position as shown in FIG. 12*d*. Upon the full downward stroke or movement of the stylus tip 17, the position as shown in 12*e*, the severed chip is cleanly removed from the stulus tip 17 and the stylus 14 is then removed outwardly from the loading mechanism 10 to repeat the process as desired.

What has been described is an angled tipped stylus and unique and novel data registering apparatus which utilizes a data processable record card and which eliminates the lengthy and time consuming problem of removing scored chips from a scored data card which has been used in accordance with the prior art devices. Moreover, the tamper-proof feature of the rectangular holder or frame for the card receiving member 70 eliminates the use of heavy plastic frame material and sheet metal holding mechanisms for mounting the card receiving members to the voting mechanism and insures that the rectangular holder or frame, when mounted in engagement with the loading mechanism, may not be tampered with during usage. However, when the election or data process has been completed, the tamper-proof member may be readily removed by the use of a blunt instrument and a new tamper-proof plate member may be utilized to repeat the operation of the present invention.

Thus, while we have illustrated and described the preferred embodiment of our invention, it is to be understood that this is capable of variation and modification, and we, therefore, do not wish to be limited to the precise details set forth, but desire to avail ourselves of such changes and alterations as fall within the purview of the following claims.

We claim:

1. A data registering apparatus, including in combination:

a housing, a base member mounted to said housing is comprised of a plurality of elongated support members spaced apart therein to define openings therein, resilient mat means mounted to said base member and having a plurality of openings therein superimposed on said spaced apart openings defined by said plurality of elongated members of said base member, anvil means having a plurality of openings therein fixedly mounted to said base member, an intermediate template means having a plurality of openings therein spaced apart from and fixedly mounted to said base member, upper mask means having a plurality of openings therein and movable from a first, at rest postion wherein the upper mask means blocks the openings in said intermediate template means and said anvil means to a second position wherein the openings in said upper mask means are in alignment with the openings in said intermediate template means and said anvil means, spring means mounted to said housing an engageable with said upper mask means to bias said upper mask means to said first, at rest position, an unscored data processable card insertable between said anvil means and said intermediate template means and engageable with said spring means to move the same and said upper mask means to said second position wherein the openings in said upper mask means are in alignment with the openings in said intermediate template means and said anvil means, a rectangular holder member adapted to receive indicia thereon engageable with said housing to hold the same in registry with the data registering apparatus, and a stylus having an angled tip thereon and adapted to be insertable through said aligned openings in said upper mask means, said intermediate template means and said anvil means to sever chips or punch portions from said unscored data processable card.

2. The data registering apparatus in accordance with claim 1 wherein said resilient mat means is one-piece and said openings are criss-crossed slits therein which cooperate with said plurality of openings in said anvil means.

3. The data registering apparatus in accordance with claim 1 wherein said anvil means is comprised of a metal and which opening edges cooperate with said angled tip of said stylus to provide a shearing action therebetween.

4. The data registering apparatus in accordance with claim 1 wherein said spring means is a finger spring member having at least one extension thereon engageable with said upper mask means to bias said upper mask means to said first, at rest position.

5. The data registering apparatus in accordance with claim 4 wherein said spring means includes a housing member which positions said spring member extension in substantially perpendicular position with respect to said housing.

6. The data registering apparatus in accordance with claim 1 wherein said rectangular holder member includes an outer mask member positioned therein which predeterminedly guides said stylus into said aligned openings.

7. The data registering apparatus in accordance with claim 1 wherein said angled stylus tip includes an angled recess of about 90 degrees.

8. The data registering apparatus in accordance with claim 1 wherein said angled stylus tip includes an angled recess of greater than about 90 degrees.

9. The data registering apparatus in accordance with claim 1 wherein said angled stylus tip includes an angled recess of less than about 90 degrees.

10. The data registering apparatus in accordance with claim 6 wherein said rectangular holder member includes a tamper-proof member engageable therewith to lock a card receiving member to said holder member.

11. A perforating stylus for use with a data registering apparatus for recording information on an unscored data record card by entering perforations on selected portions thereof, the apparatus including a lower anvil member positioned beneath said record card and providing support therefor and an intermediate template member positioned above the record card, each anvil and intermediate template members having a plurality of openings aligned with respect to each other for receiving a stylus for making said perforations in said record card comprising:

a shaft having an angled end portion, said angled end portion including a recessed center section so as to form a sharp edge around the periphery of said end portion; which edge cooperates with said anvil means to provide a shearing action in making perforations in said unscored data card.

12. A perforating stylus in accordance with claim 11 wherein said end portion thereof has a circular cross-sectional shape.

13. A perforating stylus in accordance with claim 12 wherein the recessed center section of said end portion thereof is concave.

14. A perforating stylus in accordance with claim 11 wherein said angled end portion has a recessed angle of substantially about 90 degrees.

15. A perforating stylus in accordance with claim 11 wherein said angled end portion has a recessed angle of substantially greater than 90 degrees.

16. A perforating stylus in accordance with claim 11 wherein said angled end portion has a recessed angle of substantially less than 90 degrees.

17. A data processing card for use with a data registering apparatus for recording information by entering perforations on selected portions thereof, the apparatus including a lower anvil member positioned beneath said data card and providing support therefor, an intermediate template member positioned above said data card, and a moveable upper template member, each of said anvil, intermediate template and upper template members having a plurality of openings adapted to be aligned when said upper template member is moved to an actuated position for receiving a stylus for making perforations in said data card, said card comprising, a first portion the end of which is engageable with said upper template member to move the same to said actuated position with said first portion being unscored such that upon engagement by said stylus, said stylus cooperating with said anvil member to make perforations in said first portion, and a second portion removably detachable from said first portion, said second portion engageable with said apparatus for inserting and holding said first portion in said apparatus during usage thereof.

18. A data registering apparatus, including in combination:

a housing, a base member mounted to said housing is comprised of a plurality of elongated support members spaced apart therein to define openings therein, resilient mat means mounted to said base member and having a plurality of openings therein superimposed on said spaced apart openings defined by said plurality of elongated members of said base member, anvil means having a plurality of openings therein fixedly mounted to said base member, an intermediate template means having a plurality of openings therein spaced apart from and fixedly mounted to said base member, upper mask means having a plurality of openings therein and movable from a first, at rest position wherein the upper mask means blocks the openings in said intermediate template means and said anvil means to a second position wherein the openings in said upper mask means are in alignment with the openings in said intermediate template means and said anvil means, and spring means mounted to said housing and engageable with said upper mask means to bias said upper mask means to said first, at rest position, said spring means when engaged by an unscored data processable card inserted between said anvil means and said intermediate template means moving to move said upper mask means to said second position wherein the openings in said upper mask means are in alignment with the openings in said intermediate template means and said anvil means so that chips or punch portions may be severed from said unscored data processable card.

19. The data registering apparatus in accordance with claim 18 further including a stylus adapted to be insertable through said aligned openings in said upper mask, said intermediate template, and said anvil to sever chips or punch portions from said unscored data processable card.

20. The data registering apparatus in accordance with claim 19 wherein said stylus has an angled tip thereon.

21. The data registering apparatus in accordance with claim 18 further including a rectangular holder member adapted to receive indicia thereon engagable of said housing to hold the same in registry with the data registering apparatus.

22. A data registering apparatus, including in combination:

a housing;

a base member mounted to said housing is comprised of a plurality of elongated support members spaced apart therein to define openings therein, resilient mat means mounted to said base member and having a plurality of openings therein superimposed on said spaced apart openings defined by said plurality of elongated members of said base member, anvil means having a plurality of openings therein fixedly mounted to said base member, an intermediate template means having a plurality of openings therein spaced apart from and fixedly mounted to said base member, upper mask means having a plurality of openings therein and movable from a first, at rest position wherein the upper mask means blocks the openings in said intermediate template means and said anvil means to a second position wherein the openings in said upper mask means are in alignment with the openings in said intermediate template means and said anvil means, and spring means mounted to said housing and engageable with said upper mask means to bias said upper mask means to said first, at rest position, said spring means being moved and moving said upper mask means to said second position wherein the openings in said upper mask means are in alignment with the openings in said intermediate template means and said anvil means, when an unscored data processable card is inserted between said anvil means and said intermediate template means to engage said spring means, and a stylus adapted to be insertable through said aligned openings in said upper mask means, said intermediate template means and said anvil means to sever chips or punch portions from said unscored data processable card.

23. A rectangular holder for mounting sheet panels for use with a data registering apparatus, including in combination, a frame member having one end including openings therein and a recessed groove extending across the length thereof and the end opposite said one end having openings formed by projections thereon, an outer template member having one end thereof positioned in said recessed groove in said one end and indexed and mounted on said end opposite said one end, card receiving members engageable with said openings and said recessed groove, and a tamper-proof member engageable with said end opposite said one end for securing said outer template member and said card receiving member to said frame member, with said tamper-proof member including at least one projection thereon which is sealingly engageable with openings in said end opposite said one end of said frame and therein said at least one projection is weakened to break when said tamper-proof member is parted from said frame.

* * * * *